US005308299A

United States Patent [19]

Winston

[11] Patent Number: 5,308,299

[45] Date of Patent: May 3, 1994

[54] HAND EXERCISER

[76] Inventor: Edith Winston, 135 Hazelwood Dr., Jericho, N.Y. 11753

[21] Appl. No.: 96,884

[22] Filed: Jul. 26, 1993

[51] Int. Cl.[5] ..... A63B 23/16

[52] U.S. Cl. ..... 482/49; 482/126; 482/127

[58] Field of Search ..... 482/44, 49, 50, 121, 482/122, 124, 125, 126, 127, 128

[56] References Cited

U.S. PATENT DOCUMENTS

| | | | |
|---|---|---|---|
| 1,026,215 | 5/1912 | Korth | 482/50 |
| 4,093,211 | 6/1978 | Hughes et al. | 482/122 |
| 4,632,384 | 12/1986 | Bright | 482/49 |
| 4,798,377 | 1/1989 | White | 482/49 |
| 4,943,047 | 7/1990 | Noble | 482/49 |

*Primary Examiner*—Robert Bahr
*Assistant Examiner*—Lynne A. Reichard

[57] ABSTRACT

A hand exerciser of a type having two hand grips squeezed together form an open position against the resistance of a spring and then released to again assume their open position which is achieved using a movement-limiting link, in which the link is limited in descending movement along length positions of the spring which unavoidably occur when the hand grips are together to a position which obviates "catching" on the spring that would impede opening movement. The link is held in a position where the spring connecting structure is angular rather than straight, which is less vulnerable to "catching".

1 Claim, 1 Drawing Sheet

HAND EXERCISER

The present invention relates generally to hand exercisers in the use of which hand grips are alternately closed by hand pressure against spring resistance and allowed to assume an open position, limited by a link, when the pressure is released, and more particularly, to improvements which obviate inadvertent "catching" of the link on the arms of the spring which, when it occurs, prevents the hand grips from opening and, thus, the proper use of the exercising device.

The spring of the within hand exerciser has a helical coil configuration as a body and two arms extending in an outwardly diverging relation to an appropriate connection to the respective right and left hand grips. Underlying the present invention is the recognition that, when the spring arms close along with the closed hand grips, the outwardly diverging angularity thereof is, of course, significantly diminished and, in fact, at the position of movement therealong assumed by the link, there may be little or no angularity in the spring arms. The spring arms, devoid of any angle, and more likely in a vertical orientation, are often frictionally engaged by the link, i.e. the link "catches" on these spring arms, and thus will not permit the hand exerciser to open when hard pressure is released.

Broadly, it is an object of the present invention to provide a resistance spring-operated hand exerciser overcoming the foregoing and other shortcomings of the prior art.

More particularly, it is an object to significantly prevent the "catching" or inadvertent frictional engagement between the link and spring arms, which heretofor prevented the opening of the hand grips of the hand exerciser, all as will be explained in greater detail subsequently herein.

The description of the invention which follows, together with the accompanying drawings, should not be construed as limiting the invention to the example shown and described, because those skilled in the art to which this invention appertains will be able to devise other forms thereof within the ambit of the appended claims.

Figure 1:
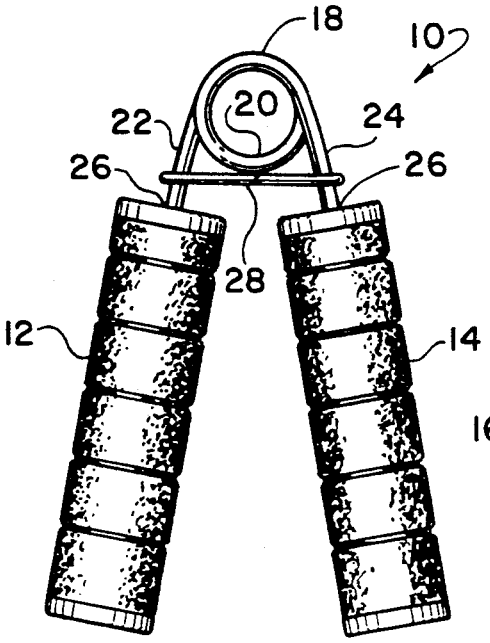
FIG.1 PRIOR ART
Figure 2:
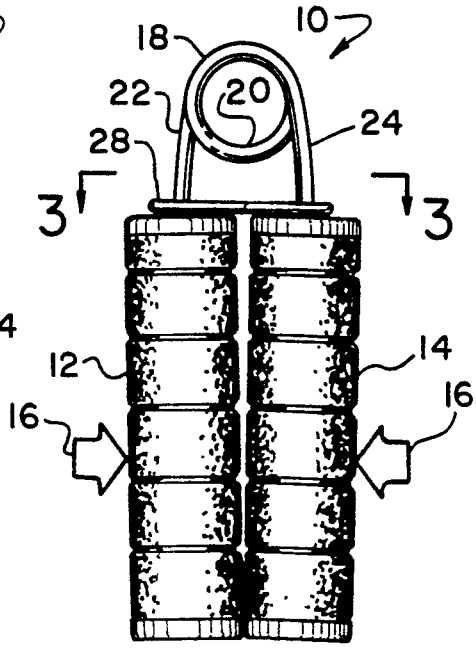
FIG.2 PRIOR ART
Figure 3:
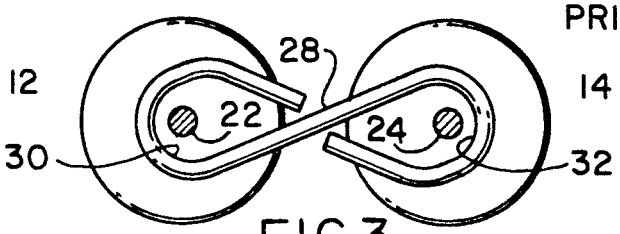
Figure 4:
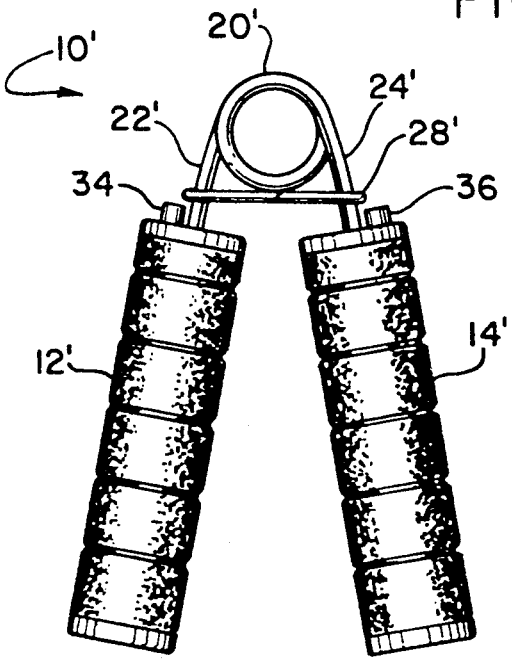
Figure 5:
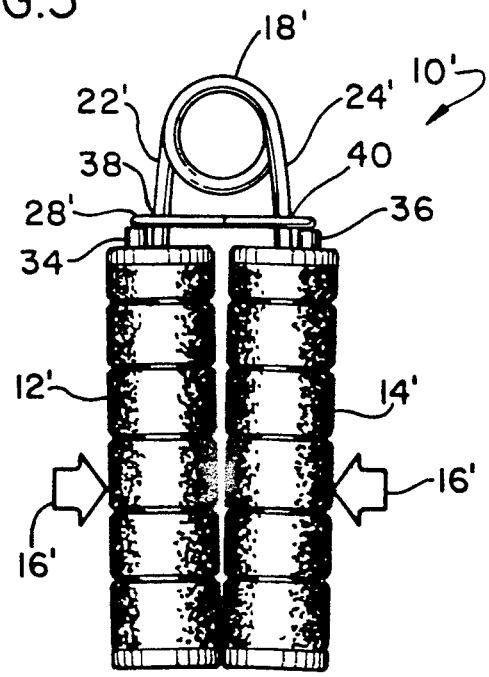

FIGS. 1 and 2 are side elevational views of a hand exerciser respectively illustrating the open and closed conditions thereof;

FIG. 3 is a plan view, on a slightly enlarged scale, taken in section along lines 3—3 of FIG. 2, which illustrates details of the link component of the hand exerciser; and FIGS. 4 and 5 are views similar to FIGS. 1 and 2, but illustrating the within inventive hand exerciser also respectively in its open and closed condition.

The within inventive hand exerciser is in the same category of exercise devices illustrated and described in my prior U.S. Pat. No. 5,060,934 issued on Oct. 29, 1991 for "Hand Exerciser", which, by this reference, is incorporated in this application. Starting first with known hand exercisers, one embodiment of which is shown in FIGS. 1–3, it will be understood to be of the type hand exerciser generally designated 10, having two hand grips 12 and 14 which preparatory to being used for exercising extend in an outwardly diverging angular relation, and which, in accordance with their intended use are squeezed together by oppositely exerted hand pressure denoted by the arrows 16 in closing movement towards each other, as illustrated in FIG. 2. When the hand pressure 16 is released, the hand grips 12 and 14 return under spring bias to the open condition of FIG. 1.

The referred-to spring bias is supplied by a helical coil spring, generally designated 18, of appropriate springy metal construction material, which, in a medial location has a helical coil configuration 20 and opposite length portions or arms 22 and 24 which extend from the helical coil configuration 20 and have the same outwardly diverging angular relation of the hand grips 20 and 24 and are ultimately connected, in an appropriate way to the tops of the hand grips 12 and 14 at the locations 26.

From what is already described, it should be readily understood that, when the pressure 16 is released and the hand grips 12 and 14 are opened under the bias of the helical coil 20, it is necessary to limit the opening movement of the hand grips away from each other. This is achieved using a link 28, as best shown in FIG. 3, which has two opposite loops 30 and 32 which are each in encircling relation respectively about the helical coil spring arms 22 and 24. More particularly, in comparing FIGS. 1 and 2, it should be readily observed that, when the hand grips are squeezed by hand pressure in closing movement towards each other against the resistance of the helical coil 20, the link 28 partakes or undergoes descending movement down along the length portion of the arms 22 and 24 which are adjacent to the tops of the hand grips 12 and 14, the lowermost position of movement of this descending movement being illustrated in FIG. 2 and being in contact against the tops of the hand grips 12 and 14. Although it is not as readily noticeable as the tracking movement just described for the link 28, it is to be understood that, in the position illustrated in FIG. 2, the link 28 will often be at a position of movement along the arms 22 and 24 where there is very little or slight outwardly diverging angularity in these arms. That is, in the position of movement illustrated in FIG. 2, the length portion of the arms within the loops 30 and 32 of the link 28 will be almost in a vertical orientation rather than in an angular orientation. As a consequence, it often occurs that, when the hand pressure 16 is released, the link 28 will inadvertently become frictionally engaged to the arm portions 22 and 24. Stated somewhat otherwise, it often inadvertently occurs that the link 28 will "catch" on the arms 22 and 24 and, thus, when the pressure 16 is released, the hand grips 12 and 14 will fail to open and assume the exercise position illustrated in FIG. 1.

Reference should now be made to the improved hand exerciser of the present invention illustrated in FIGS. 4 and 5 which, except as will be subsequently explained, is constructed similarly to the prior art exerciser of FIGS. 1 and 2, and thus the same parts thereof have been designated by the same but primed reference numerals. The improvements, more particularly, consist of providing on each hand grip 12' and 14' an upstanding projection 34 and 36 which has a position that is selected to be in the path of the descending tracking movement of the link 28'. Thus, as should be readily understood from FIG. 5, the projections 34 and 36 limit the descending tracking movement of the link 28' to a position of movement which is above the tops of the hand grips 12' and 14' and, even more important, terminate the descending tracking movement to a position which is coincident with a portion of the arms 22' and 24' that have effective outwardly diverging angularity, said referred-to positions being at the locations denoted by the reference numerals 38 and 40. As a consequence, the angularity at the locations 38 and 40 have been found in practice to contribute to obviating engagement of the link 28' to the arm projections 22' and 24'. As a further consequence, the link 28' does not impede the opening of the hand grips 12' and 14' when hand pressure 16' is released.

In a preferred embodiment, the angle subtended by the helical coil spring arms 22 and 24 is approximately 68 degrees, and the height of the projections 34 and 36 is one eighth of an inch. Thus, underlying the present invention is the recognition that, when the arms 22, 22' and 24, 24' undertake the same closing movement towards each other that occur in the hand grips 12, 12' and 14, 14' the subtended angle between these arm projections is greatest at the length portions thereof that extend from the helical coil configuration 20, 20' and progressively decrease in the direction of the attachment 26, 26' to the hand grips. Thus, in maintaining the lowermost descended position of the link 28' to one which is in a clearance position above the hand grips 12' and 14', there is assurance that there will be sufficient angularity in the helical coil spring arm projections to obviate any binding or frictional engagement of the link to these arm projections. As a consequence, and as already stated, when the hand pressure 16' is released, the hand grips 12' and 14' will assume their required open condition as shown in FIG. 4 so that the exercises with the hand exerciser 10' can be effectively conducted.

While the improved hand exerciser herein shown and disclosed in detail is fully capable in attaining the objects and providing the advantages hereinbefore stated, it is to be understood that it is merely illustrative of the presently preferred embodiment of the invention, and that no limitations are intended to the detail of construction or design herein shown other than as defined in the appended claims.

What is claimed is:

1. An improved hand exerciser of a type consisting of two hand grips extending outwardly in a diverging angular relation from each other and a helical coil spring having arm projections in a corresponding diverging angular relation connected from a helical coil configuration to said hand grips and having an operational mode in which said hand grips are squeezed by hand pressure in closing movement towards each other against the resistance of said helical coil spring and open in opposite directional movement when said hand pressure is released to assume outwardly diverging relative positions limited by a link engaged about said arm projections of said helical coil spring, said link undergoing descending tracking movement along said helical coil spring arm projections towards said hand grips when said hand grips are urged through closing movement towards each other, said improvement comprising an upstanding projection on each hand grip in said path of descending tracking movement of said link to limit said movement to a position of movement above each said hand grip which is coincident with said diverging angularly of said helical coil spring arm projections, whereby in said squeezed together position of said hand grips said diverging angular relation of said helical coil spring arm projections contributes to obviating engagement of said link to said arm projections and thereby impeding the opening of said hand grips when hand pressure is released.

* * * * *